US011559731B2

(12) United States Patent
Contreras Camejo

(10) Patent No.: US 11,559,731 B2
(45) Date of Patent: Jan. 24, 2023

(54) PORTABLE INSTRUCTIONAL BASEBALL PITCHING APPARATUS

(71) Applicant: Jose Ariel Contreras Camejo, Alva, FL (US)

(72) Inventor: Jose Ariel Contreras Camejo, Alva, FL (US)

( * ) Notice: Subject to any disclaimer, the term of this patent is extended or adjusted under 35 U.S.C. 154(b) by 78 days.

(21) Appl. No.: 16/599,406

(22) Filed: Oct. 11, 2019

(65) Prior Publication Data

US 2020/0114236 A1 Apr. 16, 2020

Related U.S. Application Data

(60) Provisional application No. 62/744,390, filed on Oct. 11, 2018.

(51) Int. Cl.
*A63B 69/00* (2006.01)

(52) U.S. Cl.
CPC .. *A63B 69/0002* (2013.01); *A63B 2069/0006* (2013.01); *A63B 2210/50* (2013.01); *A63B 2225/093* (2013.01)

(58) Field of Classification Search
CPC ... A63B 61/006; A63B 63/00; A63B 69/0097; A63B 69/0002; A63B 2069/0006; A63B 2210/50; A63B 2225/093
USPC ..... 473/422, 451, 434, 435, 462, 454, 421, 473/197, 456; 273/400–402, 407
See application file for complete search history.

(56) References Cited

U.S. PATENT DOCUMENTS 2,254,986 A * 9/1941 Ziel ..... A63B 69/0002 473/454
2,827,297 A * 3/1958 Foster ..... A63B 63/00 273/401
3,013,801 A * 12/1961 Kirkconnell, Jr. ..... A63B 63/00 473/197
3,415,519 A * 12/1968 Gene ..... F41J 1/10 273/407
3,583,703 A * 6/1971 Brown ..... A63B 63/00 473/456
4,029,318 A * 6/1977 Boss ..... F41J 1/10 273/390
4,160,549 A * 7/1979 Simpson ..... A63B 61/006 473/462
4,489,941 A * 12/1984 Shieh ..... A63B 71/022 473/456
4,718,668 A * 1/1988 Schipske ..... A63B 63/00 473/462
4,872,674 A * 10/1989 Deal ..... A63B 63/00 473/435
5,118,103 A * 6/1992 Miller ..... A63B 71/022 473/197
5,333,856 A * 8/1994 Gery ..... A63B 63/00 473/454
5,722,905 A * 3/1998 Bidelman ..... A63B 71/022 473/454

(Continued)

*Primary Examiner* — Mitra Aryanpour
(74) *Attorney, Agent, or Firm* — Shutts & Bowen LLP

(57) ABSTRACT

An apparatus for teaching baseball pitching includes a substantially flat panel having a substantially rectangular shape with adjustable height and width dimensions. The apparatus further includes at least two support members for supporting the flat panel in an upright position. The length of the support members can be adjusted to obtain a desired distance between a bottom edge of the flat panel and the ground.

15 Claims, 6 Drawing Sheets

(56) References Cited

U.S. PATENT DOCUMENTS

| | | | | |
|---|---|---|---|---|
| 6,189,889 | B1 * | 2/2001 | Yip | A63B 63/00 473/460 |
| 7,056,239 | B2 * | 6/2006 | Hickman, Jr. | A63B 69/0053 473/422 |
| 7,220,194 | B1 * | 5/2007 | Laiacona, Jr. | A63B 63/00 473/454 |
| 7,762,912 | B2 * | 7/2010 | Lewis | A63B 69/0002 473/422 |
| 8,328,665 | B2 * | 12/2012 | Meltzer | A63B 63/06 473/417 |
| 8,651,980 | B2 * | 2/2014 | Jackson | A63B 63/00 473/422 |
| 8,771,107 | B1 * | 7/2014 | Ayala | A63B 69/0002 473/422 |
| 9,227,124 | B1 * | 1/2016 | Sparks | A63B 69/0002 473/451 |
| 9,821,206 | B2 * | 11/2017 | Mosher | A63B 69/0002 473/451 |
| 9,931,555 | B1 * | 4/2018 | McCoy | A63B 69/0071 473/458 |
| 2004/0023735 | A1 * | 2/2004 | Janton | A63B 69/0097 473/434 |
| 2021/0113902 | A1 * | 4/2021 | Nuñez Lantigua | A63B 71/023 473/452 |

* cited by examiner

PORTABLE INSTRUCTIONAL BASEBALL PITCHING APPARATUS

BACKGROUND OF THE INVENTION

Field of the Invention

The present invention relates to the field of sports equipment and more importantly to equipment for teaching proper baseball pitching techniques.

Description of the Related Art

Baseball pitchers exert a large amount force when pitching that results in stress to their pitching arm, and in particular, to the shoulder and elbow joints as well as their muscles, ligaments, and tendons. Consequently, it is very important for baseball pitchers to utilize the proper form when pitching, which is commonly referred to as pitching mechanics, in order to avoid any undue stress on the pitching arm and to reduce the risk of injury.

Learning proper form and pitching mechanics can be difficult. Whether the pitcher is using a full wind-up or the pitcher is throwing from the "stretch" position, there is a great deal of movement involved with delivering the pitch. The pitcher's starting position, posture, leg kick, arm angle, follow-through, and ending position are all critical to achieve the proper technique.

In order to learn proper pitching mechanics, pitchers rely on coaches that observe their technique and offer feedback. This method of learning pitching mechanics is subjective and can be unreliable. Furthermore, it does not permit the pitcher to practice proper pitching mechanics independently.

Therefore there exists a need for a device or apparatus that can assist in teaching the proper form and technique for baseball pitchers.

BRIEF SUMMARY OF THE INVENTION

Embodiments of the present technology address deficiencies of the art in respect to equipment for teaching proper techniques to baseball pitchers. The present technology permits a baseball pitcher to practice the proper delivery of a baseball pitch, which includes the pitcher's starting position, posture, leg kick, arm angle, follow-through, and ending position. Moreover, the present technology provides an apparatus that is portable and can be adapted and used for pitchers having different dimensions, taking into account the pitcher's overall height, waist height, and stride length.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein.

DETAILED DESCRIPTION

Embodiments of the invention provide an apparatus for teaching baseball pitching. The apparatus includes a flat panel having a substantially rectangular shape with a height and a width that can be adjusted. The apparatus also includes two support members located at opposite ends of the flat panel that have adjustable heights.

Figure 1:
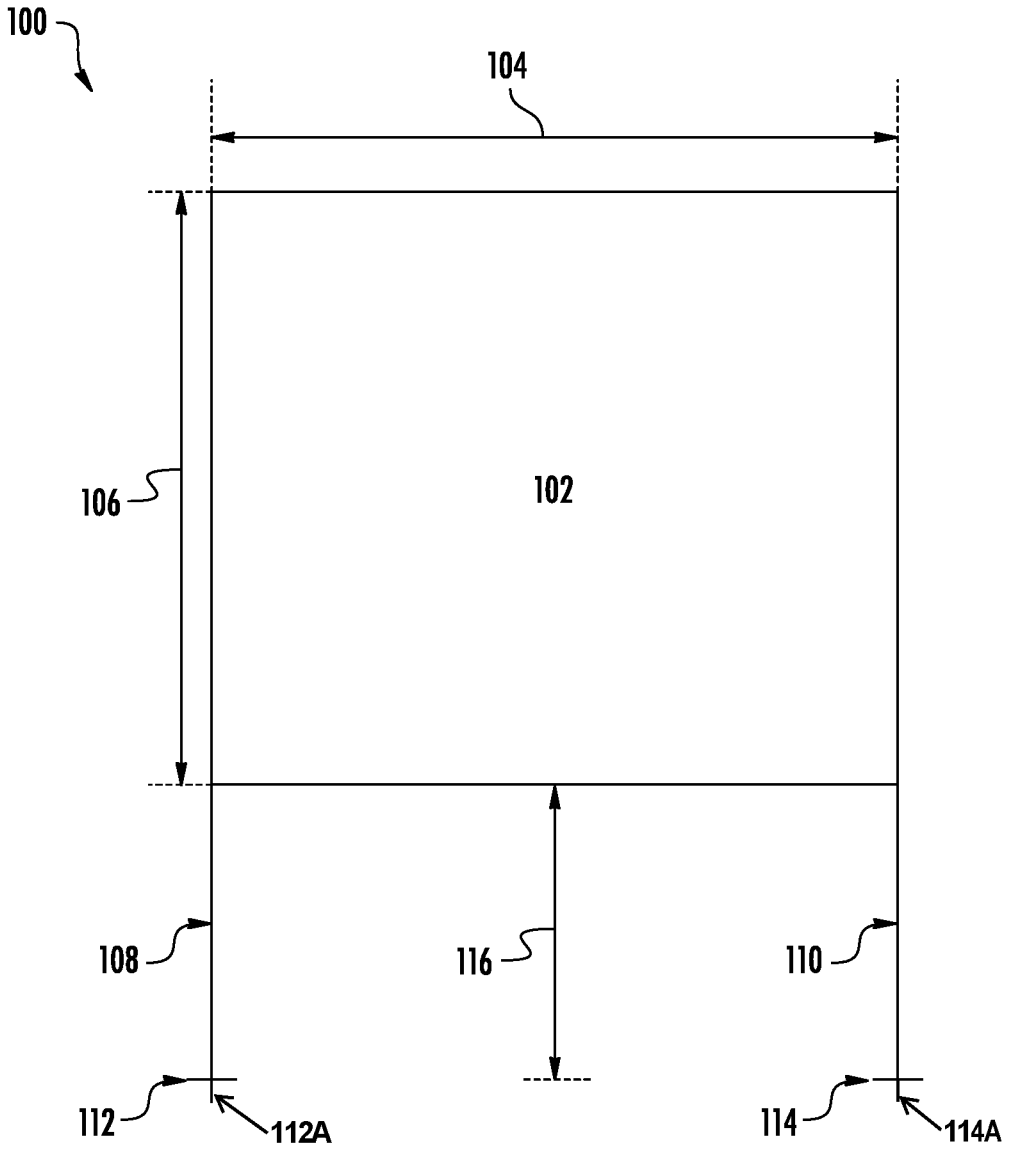
FIG. 1 illustrates an example of an apparatus for teaching baseball pitching mechanics.

In further illustration, FIG. 1 illustrates an example of a portable instructional baseball pitching apparatus 100 for teaching proper baseball pitching techniques in accordance with the present technology. The instructional pitching apparatus 100 can include a flat panel 102 having a panel width 104 and a panel height 106. Panel 102 can also have a panel thickness (not illustrated) selected according to the material and to minimize the overall weight of baseball pitching apparatus 100.

Panel 102 can be constructed from a variety of different materials. In some embodiments, panel 102 can be constructed from a rigid material such as metal or wood. Alternatively, panel 102 can be constructed from a flexible or non-rigid material such as a textile, fabric, cloth, or mesh material.

Instructional pitching apparatus 100 can also include support elements such as legs or posts 108 and 110 that are connected to panel 102 and are configured to maintain the instructional pitching apparatus 100 in an upright position. Legs 108 and 110 can be connected to panel 102 using screws, bolts, or any other suitable fastening mechanism. Some embodiments of instructional pitching apparatus 100 can have removable legs 108 and 110. Additional embodiments may include a hinge mechanism that permits legs 108 and 110 to fold for storage or transportation of instructional pitching apparatus 100. Further embodiments may also include a hinge or mechanical structure that permits panel 102 to rotate relative to legs 108 and 110. For example, panel 102 can be rotated 180 degrees relative to legs 108 and 110 and can include a mechanism for locking panel 102 at any angle between 0 and 180 degrees.

In some embodiments, legs 108 and 110 can also include a base element 112, 114 respectively. Base elements 112 and 114 can have any shape with sufficient surface area contacting the ground to provide stability to instructional pitching apparatus 100 when it is in the upright position. In some embodiments, base elements 112 and 114 can include spikes or stakes 112*a*, 114*a* for penetrating a grass or dirt surface in order to provide additional stabilization to instructional pitching apparatus 100. Alternatively, base elements 112 and 114 can also include wheels to facilitate rolling movement of instructional pitching apparatus 100. Base elements 112 and 114 can be constructed separately and can be connected to legs 108 and 110, or they can have a unitary construction with legs 108 and 110.

In some embodiments, legs 108 and 110 can have an adjustable length for raising and lowering panel 102. For example, increasing the length of legs 108 and 110 can increase distance 116 between the bottom edge of panel 102 and the ground, and decreasing the length of legs 108 and 110 can decrease the distance 116 between the bottom edge of panel 102 and the ground. The mechanism for adjusting the length of legs 108 and 110 can include a telescoping design or interchangeable legs having different lengths. In some embodiments, the legs 108 and 110 may be retracted into a frame for panel 102. Alternatively, legs 108 and 110 may include a groove or channel configured to permit panel 102 to slide up and down.

Figure 2:
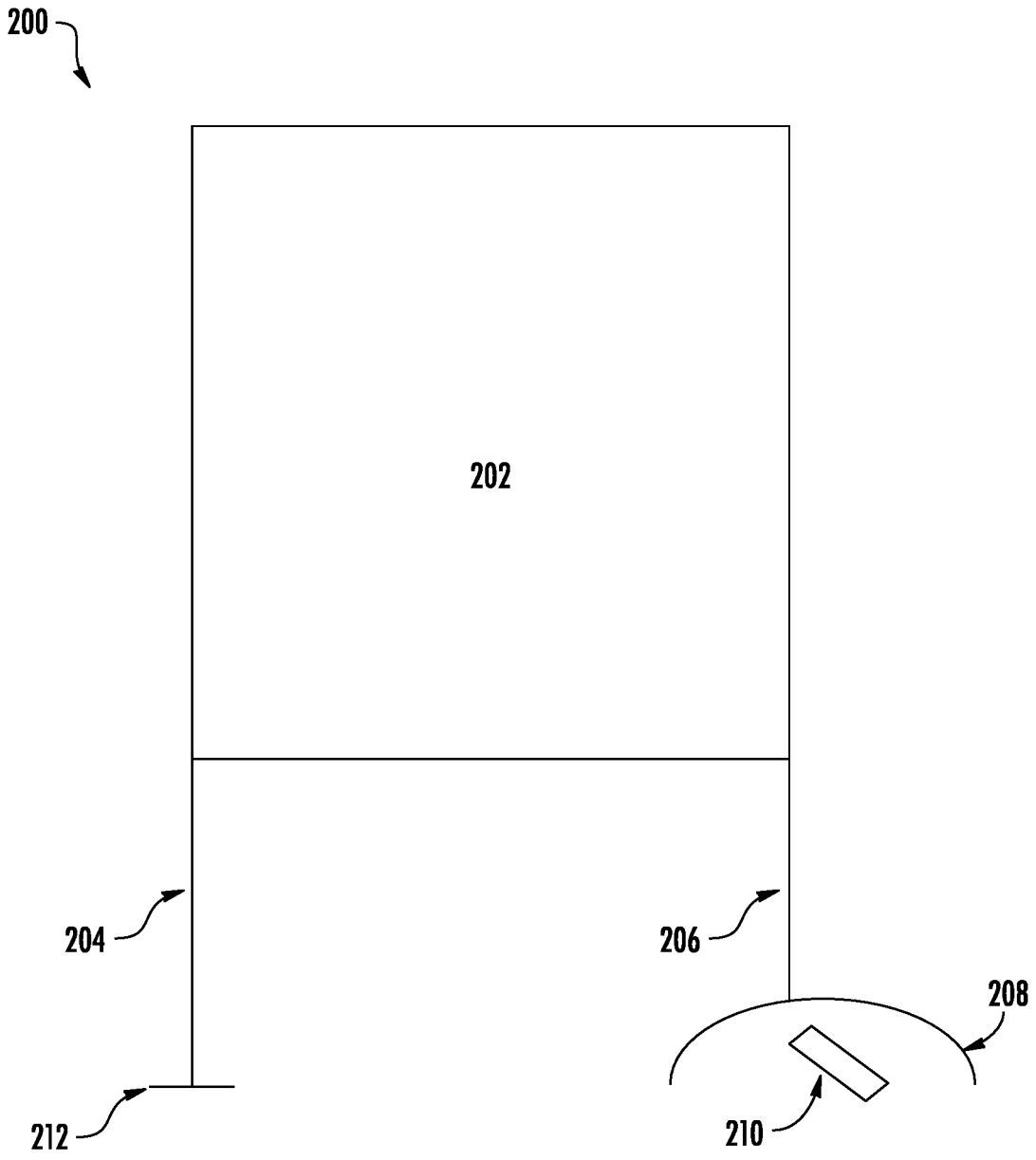
FIG. 2 illustrates a second example of an apparatus for teaching baseball pitching mechanics.

Instructional pitching apparatus 100 can be used on either flat or uneven surfaces. When a pitcher is first learning pitching mechanics, it may be preferable to utilize instructional pitching apparatus 100 on a flat surface. Advanced pitching instruction may include utilizing instructional pitching apparatus 100 on a pitcher's mound as illustrated in FIG. 2. In either case, the length of legs 108 and 110 can be independently adjusted to cause the bottom edge of panel 102 to be substantially parallel to the ground.

Adjustment of the lengths of legs 108 and 110 to change distance 116 can be used to accommodate pitchers of different heights, as discussed in further detail in connection with FIG. 4. Similarly, in some embodiments, panel width 104 and panel height 106 can also be adjusted to accommodate pitchers with different heights and different stride lengths. In some embodiments, adjustment of the lengths of legs 108 and 110 along with panel width 104 and panel height 106 can be used to minimize the overall size of instructional pitching apparatus 100 in order to facilitate storage and transportation of same.

FIG. 2 illustrates another example of a portable instructional baseball pitching apparatus 200 for teaching proper baseball pitching techniques in accordance with the present technology. As discussed in connection with FIG. 1, instructional baseball pitching apparatus 200 can include a panel 202 and legs 204 and 206.

As illustrated in FIG. 2, the side of instructional baseball pitching apparatus 200 having leg 206 is placed on a pitching mound 208 having a pitching plate or pitcher's rubber 210. Because the pitching mound 208 is elevated, leg 206 can be adjusted to a shorter length than leg 204 in order to keep the bottom edge of panel 202 substantially parallel to the ground.

In some embodiments, legs 204 and 206 can have a base element such as base element 212. Base element 212 may be detached from leg 204 to permit attachment of a different base element. For example, leg 206 may include a base element such as a spike or stake (not illustrated) that can be driven into the dirt of mound 208 while leg 204 may utilize a base element 212 such as a stand or feet adequate for stabilizing instructional baseball pitching apparatus 200 on a grass surface.

Figure 3:
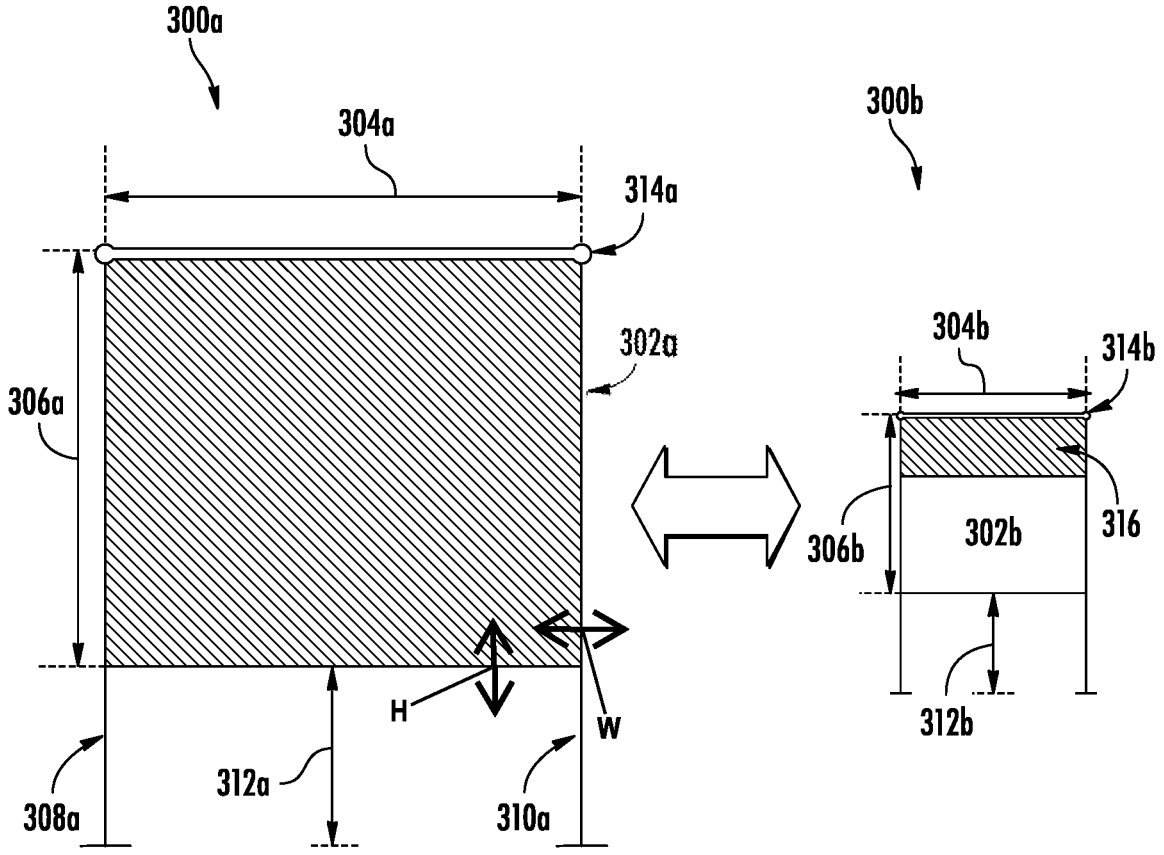
FIG. 3 illustrates an example of an adjustable apparatus for teaching baseball pitching mechanics in first and second positions, respectively.

FIG. 3 illustrates an example of an adjustable instructional baseball pitching apparatus for teaching baseball pitching mechanics in first and second positions, respectively. In the first position, instructional pitching apparatus 300*a* is illustrated having a flat panel 302*a* that is expanded and has a substantially rectangular shape. Flat panel 302*a* can have a panel width 304*a* and a panel height 306*a*. Panel 302*a* can have adjustable dimensions such that panel width 304*a* and panel height 306*a* can be increased and decreased in directions W and H, respectively, to accommodate pitchers of different heights. For example, the outer frame of panel 302*a* can be configured with telescoping elements that can be used to adjust panel width 304*a* and panel height 306*a*.

In some embodiments, the pitching apparatus can include a shaft 314*a* that can be used to dispense a mesh or cloth material for panel 302*a*. The material dispensed from shaft 314*a* can be attached or connected to the elements that make up the frame of panel 302*a*. Shaft 314*a* can also include telescoping elements to permit adjusting its length. In some embodiments, mechanical shaft 314*a* may include an electric motor that facilitates re-sizing panel 302*a*.

In other embodiments, the pitching apparatus may include adjustable sub-panels (not illustrated) that slide relative to each other in horizontal and/or vertical directions. The adjustable sub-panels can be used to adjust panel width 304*a* and panel height 306*a*.

Panel 302*a* can be supported by adjustable legs 308*a* and 310*a*. The length of adjustable legs 308*a* and 310*a* can be used to determine the distance 312*a* between the ground/floor and a bottom edge of panel 302*a*. The dimensions of panel 302*a* and the distance 312*a* between the ground and a bottom edge of panel 302*a* are customized according to the pitcher that is using instructional pitching apparatus 300*a*. For example, instructional pitching apparatus 300*a* can be reconfigured to have a smaller panel 302*b* and shorter distance 312*b* as illustrated in connection with instructional pitching apparatus 300*b*.

Similarly, height and width of the panel can be adjusted to accommodate different pitchers. Instructional pitching apparatus 300*b* is illustrated with a shorter panel width 304*b* and shorter panel height 306*b*. Pitching apparatus 300*b* illustrates partially retracted material 316 as dispensed from a structure such as shaft 314*b*.

Figure 4:
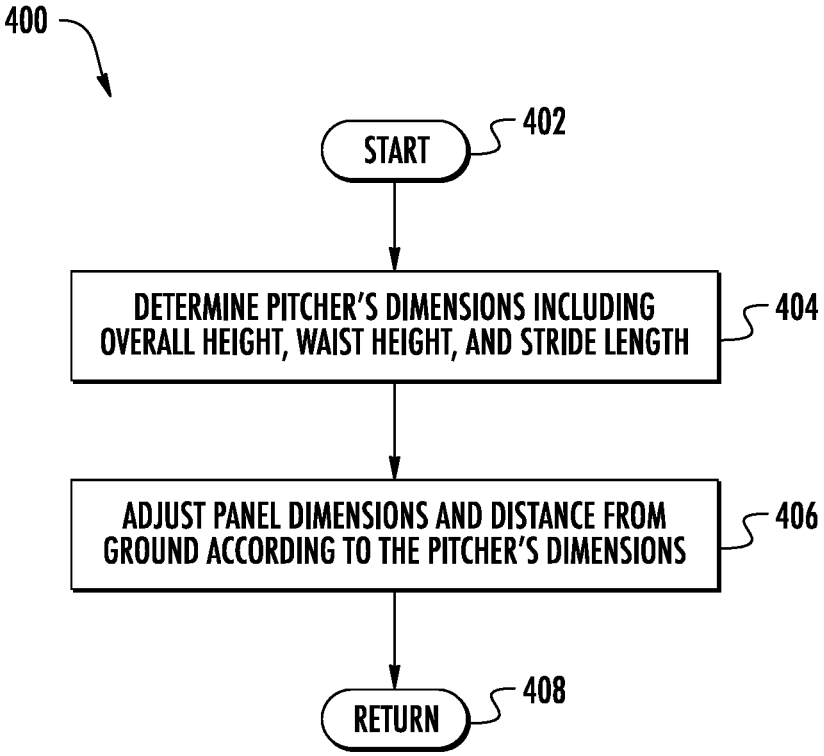
FIG. 4 illustrates an example method for teaching baseball pitching mechanics.

FIG. 4 illustrates an example method 400 for teaching baseball pitching mechanics utilizing an instructional baseball pitching apparatus according to the present technology. The method starts at step 402 and continues to step 404 in which the user's (pitcher's) dimensions are determined. These dimensions can include, for example, the pitcher's height, inseam, waist height, torso length, arm length, and pitching stride length. Pitching stride length can be calculated by measuring the horizontal distance from trailing or planting foot to the point at which the stride foot contacts the ground.

Once the pitcher's dimensions are calculated, the method can proceed to step 406 in which an instructional baseball pitching apparatus can be adjusted according to the pitcher's dimensions. Referring to the reference designators in FIG. 1, the legs or support members 108 and 110 of instructional pitching apparatus 100 can be adjusted to set the distance 116 between a bottom edge of panel 102 and the ground. Distance 116 can be adjusted to instruct the pitcher on the proper leg kick for pitching. When the pitcher commences the pitching motion, his/her leg kick will be limited by distance 116 because the pitcher's leg will make contact with a bottom edge of panel 102. In some embodiments, distance 116 can be approximately set to the pitcher's waist height.

As the pitcher proceeds through the pitching motion, distance 116 can also instruct the pitcher on proper shoulder height at the point of pitch delivery. That is, when the pitcher's arm is fully extended, it can be substantially parallel to a bottom edge of panel 102 and the pitching shoulder can make contact with said bottom edge.

Similarly, panel 102 can also be adjusted according to the pitcher's dimensions. For example, panel height 106 can be selected such that a top edge of panel 102 is approximately the height of the pitcher. Panel length 104 can also be adjusted according to the pitcher's height, arm length, and pitching stride length. As explained above, when the pitcher's arm is fully extended, it can be substantially parallel to a bottom edge of panel 102. Thus, panel length 104 can be adjusted to permit full extension of the pitching arm according to the pitcher's height, torso length, and arm length.

Panel length 104 can also be adjusted according to a pitcher's pitching stride length. Pitchers of the same height may have different stride lengths due to different proportions or different techniques. In some embodiments, panel length 104 can be selected to teach appropriate pitching stride length. The pitcher can determine whether he/she is under or over striding based on the position of the pitching hand relative to panel length 104.

Figure 5D:
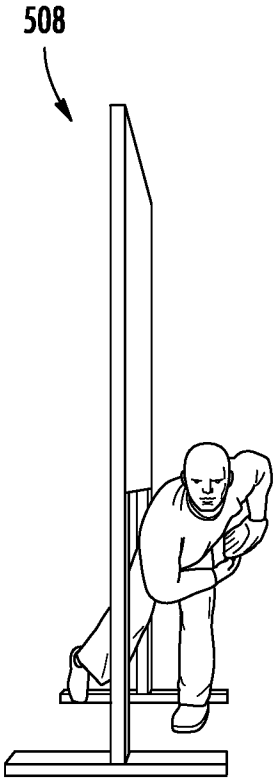
FIGS. 5A, 5B, 5C, and 5D illustrate use of an instructional baseball pitching apparatus from a front perspective.
Figure 5C:
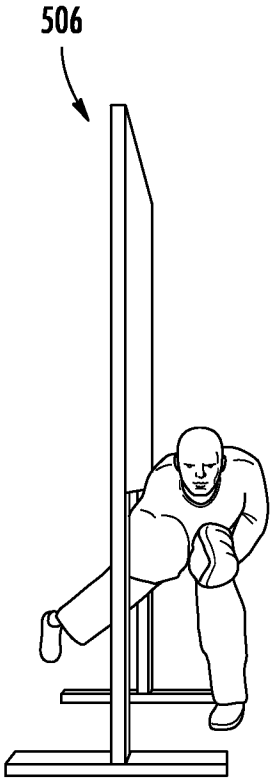
Figure 5B:
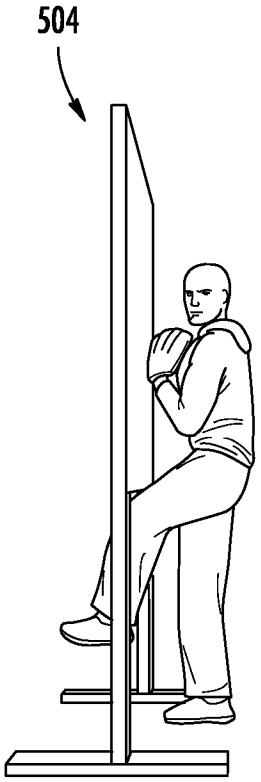
Figure 5A:
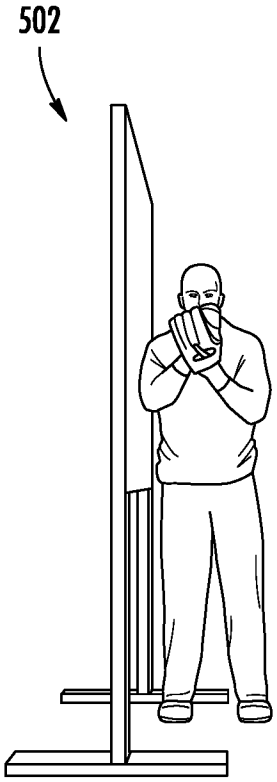

FIGS. 5A, 5B, 5C, and 5D illustrate use of an instructional baseball pitching apparatus from a front perspective. FIG. 5A illustrates a start position in which the pitcher stands adjacent to the apparatus with feet approximately shoulder-width apart with the pitcher's back substantially parallel to a side edge of the panel.

FIG. 5B illustrates the pitcher's leg kick, the height of which may be dictated by the distance between a bottom edge of the panel and the ground. FIG. 5C illustrates the point at which the pitcher releases the baseball. As illustrated, the pitcher's arm is substantially parallel to a bottom edge of the panel and the pitcher's pitching shoulder is at a height set by the bottom edge of the panel. FIG. 5D illustrates the finish position. The pitcher's pitching arm is bent to approximately 90 degrees at the elbow with the upper portion being substantially parallel to the panel. The bottom backside of the pitcher's torso is positioned underneath a bottom edge of the panel. FIGS. 5A to 5D also illustrate proper positioning of pitcher's non-throwing arm throughout the pitching motion. The non-pitching arm is kept tucked and folded at less than 90 degrees throughout the pitching motion.

Figure 6A:
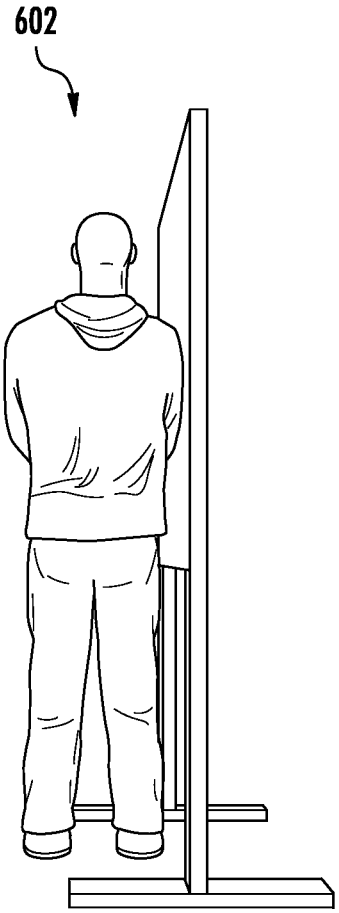
FIGS. 6A and 6B illustrate use of an instructional baseball pitching apparatus from a backside perspective.
Figure 6B:
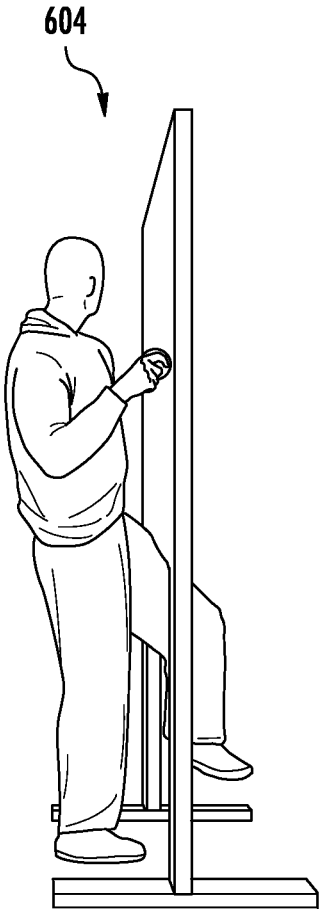

FIGS. 6A and 6B illustrate use of an instructional baseball pitching apparatus from a backside perspective. FIG. 6A illustrates a start position in which the pitcher stands adjacent to the apparatus with feet approximately shoulder-width apart. The pitcher's back is substantially parallel to a side edge of the panel and the pitching arm can make contact with the panel. FIG. 6B illustrates the pitcher's leg kick in which a bottom edge of the panel makes contact with the pitcher's thigh at a point approximately mid-way between the knee and waist. While the pitcher illustrated in FIGS. 5 and 6 are right-handed, it can be appreciated by those skilled in the art that the instructional pitching apparatus can also be used to teach pitching mechanics to left-handed pitchers.

The above detailed description is intended to highlight various features and aspects of the invention by discussing specific attributes of particular embodiments of the invention. Persons of ordinary skill in the art will recognize that various changes can be made to the described embodiments without departing from the scope of the invention. All such modifications are intended to be within the scope and spirit of the apparatuses, systems, and methods described herein.

The invention claimed is:

1. An apparatus for teaching baseball pitching, comprising:

an elongated pitching plate having a greater length than width and placed on a pitching mound having a front end and rear end and defining a longitudinal ball pitching axis extending from the rear end to the front end, the elongated pitching plate length extending substantially perpendicular to the longitudinal ball pitching axis;

a substantially flat panel placed on the pitching mound substantially parallel to the longitudinal ball pitching axis having a top edge, a bottom edge, a first side edge and a second side edge, wherein the distance between the top edge and the bottom edge defines a panel height and the distance between the first side edge and the second side edge defines a panel width;

a first partition support member disposed proximate to the first side edge along the bottom edge of the flat panel; and a second partition support member disposed proximate to the second side edge along the bottom edge of the flat panel, wherein the first partition support member and the second partition support member are configured to maintain the flat panel in a substantially upright position.

2. The apparatus of claim 1, wherein the first partition support member and the second partition support member are removably attached to the flat panel.

3. The apparatus of claim 1, wherein the first partition support member and the second partition support member comprise a stake or spike suitable for penetrating a grass or dirt surface.

4. The apparatus of claim 1, wherein the first partition support member and the second partition support member each have independently adjustable heights.

5. The apparatus of claim 1, wherein the flat panel is formed from a non-rigid material.

6. The apparatus of claim 5, wherein the non-rigid material is a mesh cloth or fabric.

7. The apparatus of claim 1, wherein the panel height and the panel width are adjustable.

8. The apparatus of claim 1, further comprising a carrying case, wherein the flat panel, the first partition support member, and the second partition support member can each be placed inside the carrying case.

9. A method of teaching baseball pitching techniques, comprising:

determining an overall height of a pitcher and a waist height of the pitcher;

configuring a panel height dimension of an adjustable flat panel according to a difference between the overall height and the waist height of the pitcher; and configuring a first length of a first partition support member and a second length of a second partition support member, wherein the first partition support member and the second partition support member are attached to a bottom edge of the adjustable flat panel, and wherein the first length and the second length are selected based on the waist height of the pitcher.

10. The method of claim 9, wherein a distance between the bottom edge of the adjustable flat panel and a ground surface is substantially the same as the waist height of the pitcher.

11. The method of claim 9, further comprising:

determining a stride length of the pitcher; and further configuring a panel length dimension of the adjustable flat panel according to the stride length.

12. The apparatus of claim 4, wherein one of the first and second partition support members is configured to be placed on a higher point of the pitcher's mound than an other of the one of the first and second partition support members and the height of each of the first and second partition support members is adjusted so that the bottom edge of the flat panel remains substantially parallel with a top surface of the pitching plate.

13. The apparatus of claim 7, wherein the panel height is adjusted corresponding to a difference between an overall height and a waist height of a pitcher.

14. The apparatus of claim 7, wherein the panel width is adjusted corresponding to a stride length of a pitcher.

15. The apparatus of claim 7, wherein a distance of the bottom edge of the flat panel to the pitching mound is adjusted corresponding to a waist height of a pitcher.

* * * * *